US007484866B1

(12) United States Patent
Buse

(10) Patent No.: US 7,484,866 B1
(45) Date of Patent: Feb. 3, 2009

(54) ADJUSTABLE LIGHTING FIXTURE FOR SLOPED CEILING

(75) Inventor: John Jeffrey Buse, Mantachie, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 168 days.

(21) Appl. No.: 11/382,314

(22) Filed: May 9, 2006

(51) Int. Cl.
*F21V 15/00* (2006.01)

(52) U.S. Cl. ..... 362/366; 362/147; 362/285; 362/418

(58) Field of Classification Search ..... 362/364–366, 362/269, 285, 287, 418, 370, 371, 147
See application file for complete search history.

(56) References Cited

U.S. PATENT DOCUMENTS

| | | | | |
|---|---|---|---|---|
| 394,680 | A | | 10/1888 | Dawes |
| 393,126 | A | | 11/1888 | Smart |
| 684,264 | A | | 10/1901 | Kemmerer |
| 866,473 | A | | 9/1907 | Keefe et al. |
| 1,038,705 | A | | 9/1912 | Yantis |
| 1,127,527 | A | | 2/1915 | Schoen |
| 1,137,906 | A | | 5/1915 | Rosenberg |
| 1,501,524 | A | | 7/1924 | Cousins |
| 1,631,488 | A | | 6/1927 | Jones |
| 1,662,568 | A | | 3/1928 | Foell |
| 1,704,626 | A | | 3/1929 | Nero |
| 1,882,185 | A | * | 10/1932 | Graham ..... 362/427 |
| 2,166,394 | A | * | 7/1939 | Crossley ..... 362/371 |
| 2,518,936 | A | | 8/1950 | Roberts |
| 2,554,258 | A | | 5/1951 | Lundquist |
| 2,639,368 | A | | 5/1953 | Pryne |
| 2,647,202 | A | | 7/1953 | Elmer |
| 2,716,185 | A | | 8/1955 | Burliuk et al. |
| 2,739,226 | A | | 3/1956 | Rex |
| 2,753,445 | A | | 7/1956 | Thomas et al. |
| 2,757,818 | A | | 8/1956 | Chanberlain |
| 2,762,598 | A | | 9/1956 | Runge |
| 2,802,933 | A | | 8/1957 | Broadwin |
| 2,842,281 | A | | 7/1958 | Chisholm |
| 2,859,333 | A | | 11/1958 | Burliuk et al. |
| 2,922,030 | A | | 1/1960 | Bobrick |
| 2,937,841 | A | | 5/1960 | Bodian |
| 2,965,348 | A | | 12/1960 | Gerstel et al. |
| 3,057,993 | A | | 10/1962 | Gellert |
| 3,082,023 | A | | 3/1963 | Rudolph et al. |
| 3,097,903 | A | * | 7/1963 | Moore ..... 439/237 |
| 3,168,252 | A | | 2/1965 | Cagernoch |
| 3,182,187 | A | | 5/1965 | Gellert |
| 3,313,931 | A | | 4/1967 | Klugman |
| 3,381,123 | A | | 4/1968 | Docimo |
| 3,420,995 | A | | 1/1969 | Dunckel |
| 3,512,743 | A | | 5/1970 | Lipscomb |
| 3,518,420 | A | | 6/1970 | Kripp |
| 3,590,241 | A | | 6/1971 | Docimo et al. |

(Continued)

*Primary Examiner*—Sandra L. O'Shea
*Assistant Examiner*—Gunyoung T. Lee
(74) *Attorney, Agent, or Firm*—John F. Salazar; Middleton Reutlinger

(57) ABSTRACT

The invention provides a lighting fixture for a sloped ceiling comprising an enclosure, an optics assembly situated within the enclosure, and at least one gravity-controlled pendulum with an indicator capable of being used to align the optics assembly. The lighting fixture further comprises a yoke assembly comprising a yoke and a secondary support piece, and at least one connector that guides the movement of the yoke.

11 Claims, 11 Drawing Sheets

U.S. PATENT DOCUMENTS 3,609,346 A 9/1971 Lund et al.
3,660,651 A * 5/1972 Miles, Jr. ..... 362/366
3,683,173 A 8/1972 Guth, Jr.
3,697,742 A 10/1972 Bobrick
3,700,885 A 10/1972 Bobrick
3,749,873 A 7/1973 Harper et al.
3,778,609 A 12/1973 Ligerman
3,872,296 A 3/1975 Cohen et al.
4,039,822 A 8/1977 Chan et al.
4,086,480 A 4/1978 Lahm
4,142,227 A 2/1979 Aikens
4,173,037 A * 10/1979 Henderson et al. ..... 362/287
4,232,361 A 11/1980 Kelsall
4,250,540 A 2/1981 Kristofek
4,274,615 A 6/1981 Chan et al.
4,293,895 A 10/1981 Kristofek
4,318,161 A 3/1982 Shanks
4,318,162 A 3/1982 Sip
4,336,575 A 6/1982 Gilman
4,382,274 A 5/1983 De Backer et al.
4,408,262 A 10/1983 Kusmer
4,414,617 A 11/1983 Galindo
4,431,151 A 2/1984 Schonasky
4,459,648 A 7/1984 Ullman
4,471,416 A 9/1984 Druffel
4,473,873 A 9/1984 Quiogue
4,475,147 A 10/1984 Kristofek
4,510,559 A 4/1985 Kristofek
4,605,816 A 8/1986 Jorgensen et al.
4,623,956 A 11/1986 Conti
4,646,212 A 2/1987 Florence
4,704,664 A 11/1987 McNair
4,729,080 A 3/1988 Fremont et al.
4,733,339 A 3/1988 Kelsall
4,745,533 A 5/1988 Smerz
4,751,624 A 6/1988 Russo et al.
4,751,627 A 6/1988 Usher
4,754,377 A 6/1988 Wenman
4,829,410 A 5/1989 Patel
4,881,157 A * 11/1989 Pahl ..... 362/371
4,887,196 A 12/1989 Brown et al.
5,045,985 A 9/1991 Russo et al.
5,068,772 A 11/1991 Shapiro et al.
5,122,944 A 6/1992 Webb
5,124,901 A 6/1992 Sojka et al.
5,130,914 A 7/1992 Bengochea
5,222,800 A 6/1993 Chan et al.
5,291,381 A 3/1994 Price
5,314,148 A 5/1994 Jones
5,317,493 A 5/1994 Muller et al.
5,373,431 A 12/1994 Hayman et al.
5,377,088 A 12/1994 Lecluze
5,452,193 A 9/1995 Hinnefeld et al.
5,457,617 A 10/1995 Chan et al.
5,538,214 A 7/1996 Sinila
5,556,188 A 9/1996 Poppenheimer
5,562,343 A * 10/1996 Chan et al. ..... 362/365
5,564,815 A 10/1996 Litman et al.
5,567,041 A 10/1996 Slocum
5,609,414 A 3/1997 Caluori
5,630,663 A 5/1997 Ling et al.
5,669,324 A 9/1997 Muir, III
5,672,004 A 9/1997 Schmidt, Jr.
5,738,436 A 4/1998 Cummings et al.
5,758,959 A 6/1998 Sieczkowski
5,800,050 A 9/1998 Leadford
5,823,664 A 10/1998 Demshke, Jr. et al.
5,826,970 A 10/1998 Keller et al.
5,857,766 A 1/1999 Sieczkowski
5,941,625 A 8/1999 Morand
5,951,151 A 9/1999 Doubeck et al.
6,079,852 A 6/2000 Kamaya et al.
6,095,669 A * 8/2000 Cho ..... 362/365
6,113,245 A 9/2000 Reinert, Sr.
6,132,245 A 10/2000 Wertz et al.
6,142,439 A 11/2000 Aramaki
6,145,798 A 11/2000 Janisse et al.
6,220,728 B1 4/2001 Andrus et al.
6,234,644 B1 5/2001 Kotovsky et al.
6,270,238 B1 8/2001 Mendelsohn et al.
6,343,873 B1 2/2002 Eberhard et al.
6,364,510 B1 4/2002 Bernhart et al.
6,375,338 B1 4/2002 Cummings et al.
6,402,112 B1 * 6/2002 Thomas et al. ..... 248/317
6,431,723 B1 8/2002 Schubert et al.
6,471,374 B1 * 10/2002 Thomas et al. ..... 362/285
6,505,960 B2 1/2003 Schubert et al.
6,543,915 B1 4/2003 Chen
7,118,254 B2 10/2006 Czech
7,234,674 B2 6/2007 Rippel et al.
7,303,314 B2 * 12/2007 Jones ..... 362/282
2006/0193142 A1 * 8/2006 Dupre ..... 362/418

* cited by examiner

ADJUSTABLE LIGHTING FIXTURE FOR SLOPED CEILING

CROSS-REFERENCE TO RELATED APPLICATIONS

Not applicable

BACKGROUND OF THE INVENTION

1. Field of the Invention

The present invention relates to a lighting fixture for a sloped ceiling, whose position can be easily adjusted. More particularly, the present invention relates to a lighting fixture having an optics assembly and a gravity-controlled pendulum with an indicator that facilitates correct positioning of the optics assembly.

2. Background of the Invention

Many residential and commercial buildings have rooms with sloped ceilings. Lighting fixtures recessed within the ceiling are often used to light these rooms in an effective and inconspicuous way. To perform optimally, it is important that the optics assemblies of these lighting fixtures be properly aligned in a vertical position. These fixtures typically have optics assemblies that are adjustable for use with ceilings having a particular slope. The fixtures have markings that aid a person in aligning them correctly. A ceiling sloped at 30 degrees, for example, would require a fixture that has a "30 degree" marking. When adjusted properly in accordance with the marking, the optics should point downward as long as the slope of the ceiling is exactly 30 degrees.

Unfortunately, the slope of a ceiling as designed often does not precisely match the slope of the ceiling after it has been built. As a result, lighting fixtures designed for ceilings sloped at a particular angle do not lead to perfectly aligned optics assemblies even when markings are employed to facilitate the process. Multiple adjustments are sometimes necessary in order to place the lighting fixture in the correct position. Since the installment and adjustment of ceiling lights usually requires a person to climb up a ladder and work in high places, the process is physically awkward, time-consuming, tedious, and somewhat dangerous.

SUMMARY OF THE INVENTION

It is an object of the invention to provide an easily adjustable lighting fixture for a sloped ceiling.

It is a further object of the invention to provide a lighting fixture for a sloped ceiling with a mechanism capable of being used to align the optics assembly to accommodate a range of sloped ceiling angles.

It is also an object of the invention to provide a method by which the lighting fixture of the invention can be adjusted.

Specifically, a lighting fixture is disclosed for a sloped ceiling comprising an enclosure, an optics assembly situated within the enclosure, and at least one gravity-controlled pendulum with an indicator capable of being used to align the optics assembly. The enclosure preferably has at least one reference hole through which the indicator of the gravity-controlled pendulum can be viewed during the alignment process.

The optics assembly further comprises a yoke assembly and a reflector. The yoke assembly comprises an adjustable yoke in which the reflector is housed so that the yoke and the reflector move in concert. The yoke assembly further comprises at least one secondary support piece, which is preferably stationary. The secondary support piece has a curved track opening into which a connector fits, thereby forming a hinge where the yoke and the secondary support piece are attached. When the connectors slide along the curved track opening, the yoke and the reflector move along an axis defined by the hinge so that the optics assembly is easily adjusted.

The gravity-controlled pendulum can be placed anywhere on the yoke, and it preferably rotates freely on the yoke so that when the connector moves along the curved track opening, the gravity-controlled pendulum remains in a constant position with respect to the ground. In one embodiment, the gravity-controlled pendulum is placed on a thumbscrew that attaches the secondary support piece to the yoke and fixes the optics assembly in place when it is tightened.

To properly align the lighting fixture, the user placing the lighting fixture in or on the ceiling can adjust the optics assembly until the indicator of the gravity-controlled pendulum is in the center of the reference hole. Once this adjustment is made, the optics assembly is pointing down, and the lighting fixture should be ready for use.

BRIEF DESCRIPTION OF THE DRAWINGS

The aspects and advantages of the present invention will be better understood when the detailed description of the preferred embodiment is taken in conjunction with the accompanying drawings, in which.

DETAILED DESCRIPTION OF THE INVENTION

While this invention is capable of embodiments in many different forms, multiple embodiments are shown in the figures and will be herein described in detail. The present disclosure is to be considered an exemplification of the principles of the invention and is not intended to limit the broad aspects of the invention to the embodiments illustrated.

Figure 1A:
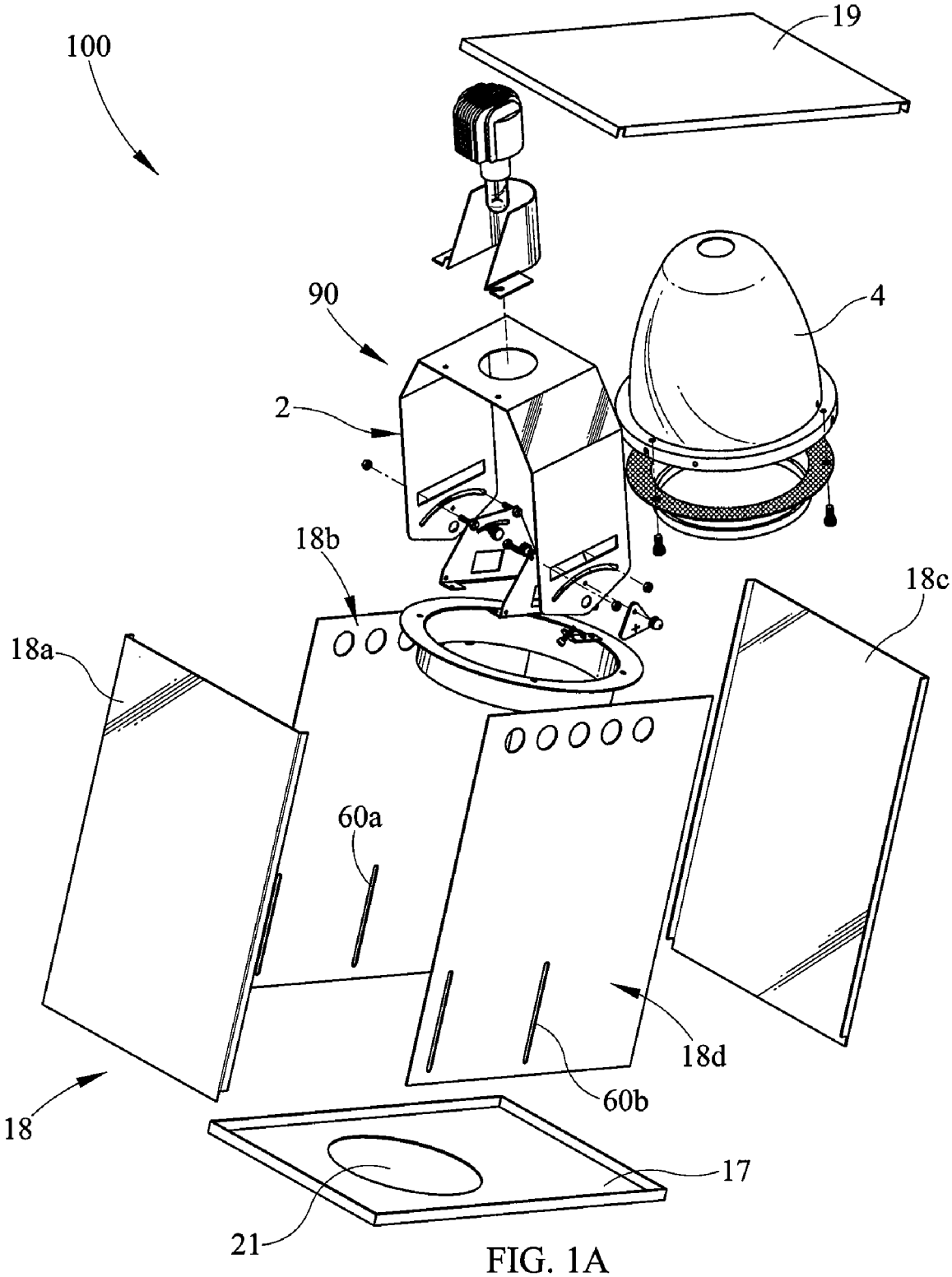
FIGS. 1*a*-1*b* are exploded views of the lighting fixture of the present invention.
Figure 1B:
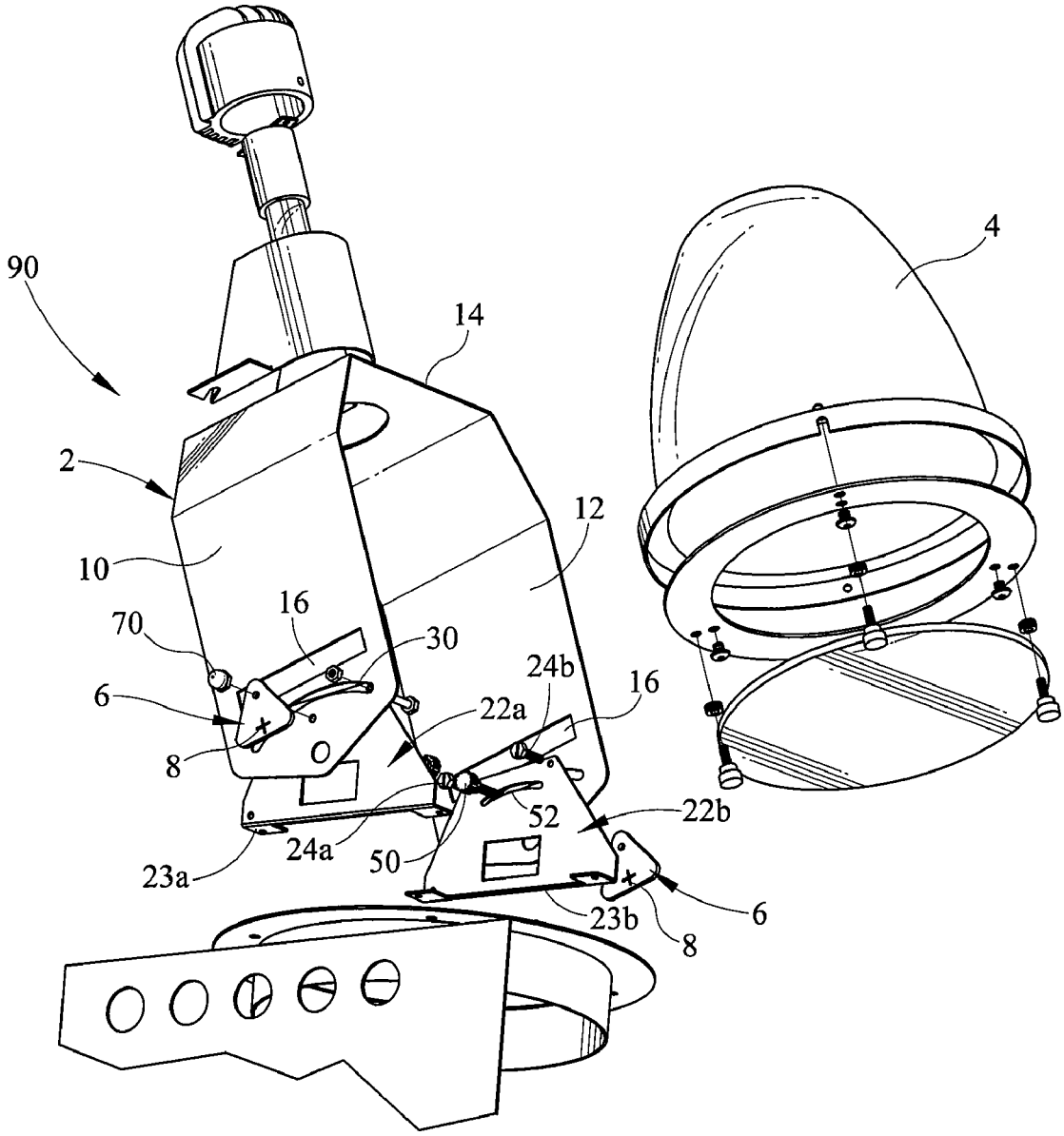
Figure 1C:
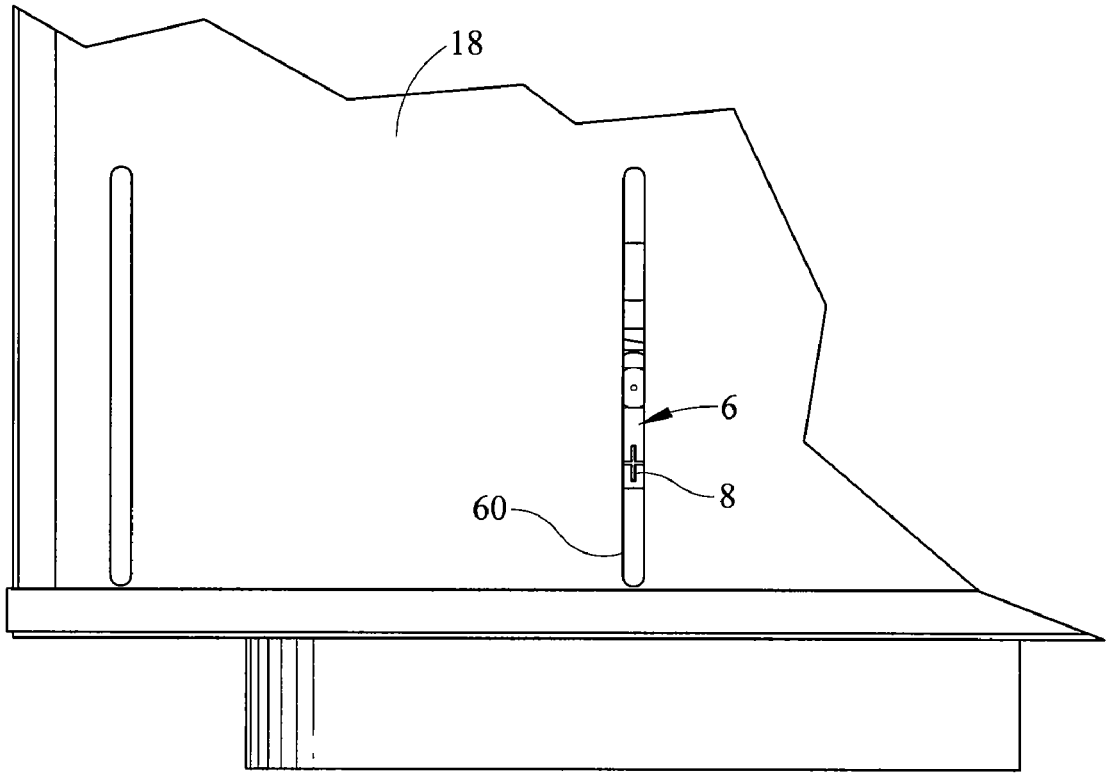
FIG. 1*c* is a close-up view of a portion of the enclosure of the lighting fixture of the present invention.

Referring now to the drawings and initially to FIGS. 1*a*-1*c*, a lighting fixture 100 for a sloped ceiling comprises an enclosure 18, an optics assembly comprising a reflector 4 and a yoke assembly 2 (FIGS. 1*a*-1*b*) that guides the movement of the reflector 4, and at least one gravity-controlled pendulum 6 (FIGS. 1*a-c*, FIG. 2) to indicate when the optics assembly is properly aligned.

For recessed lighting fixtures to perform optimally, their optics assemblies must point downward. The force of gravity always pulls the gravity-controlled pendulum 6 downward, which makes it easier to identify when the optics assembly is aligned correctly. The gravity-controlled pendulum 6 preferably has at least one indicator 8 (FIGS. 1*b*, 1*c*, FIG. 2) that can further simplify the alignment process. In one embodiment of the invention, the gravity-controlled pendulum 6 is triangular, and the indicator 8 is in the shape of a plus sign, wherein the vertical line on the plus sign of the indicator 8 always faces downward.

Figure 2:
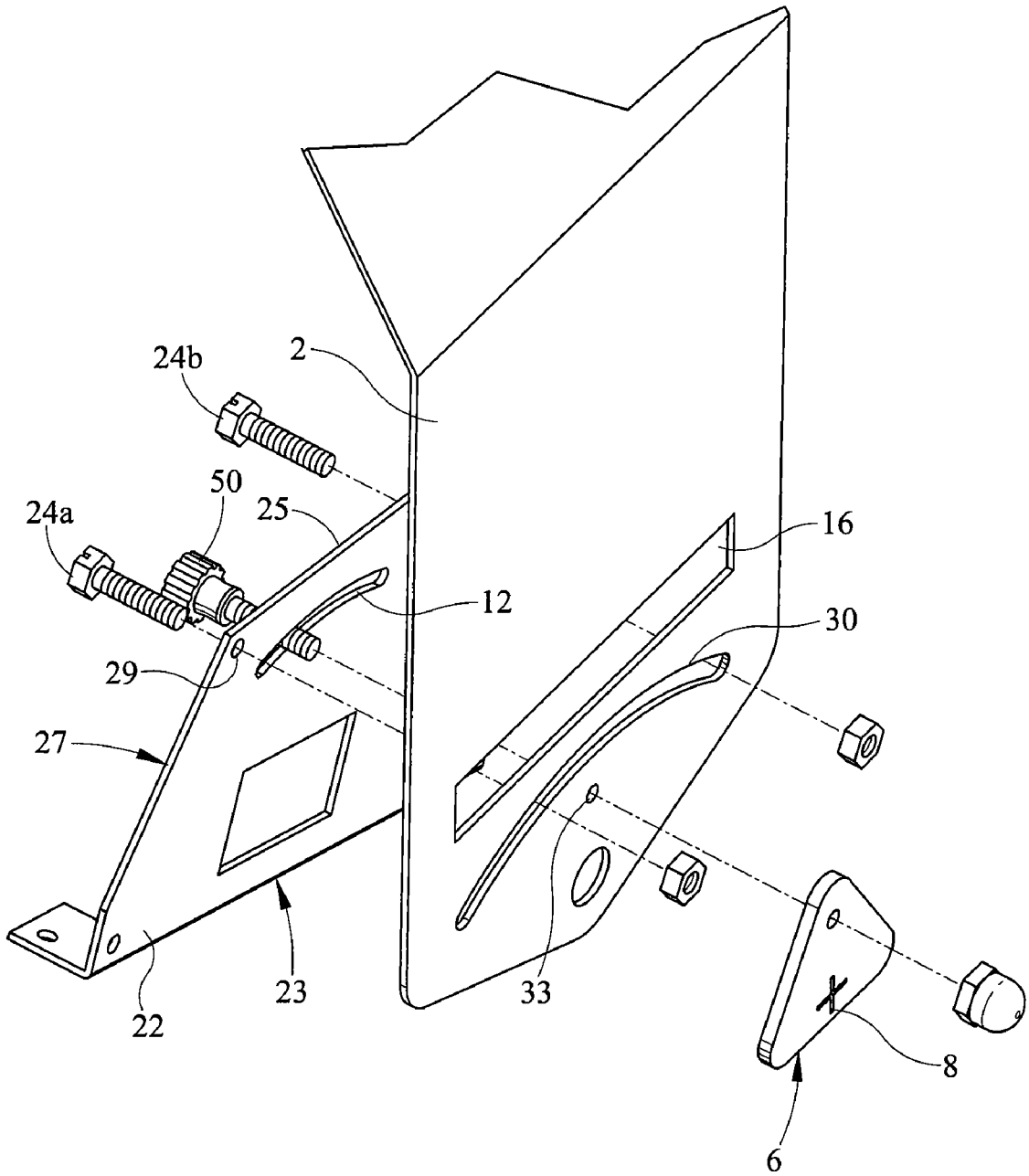
FIG. 2 is a side perspective view of parts of the hinge.
Figure 3A:
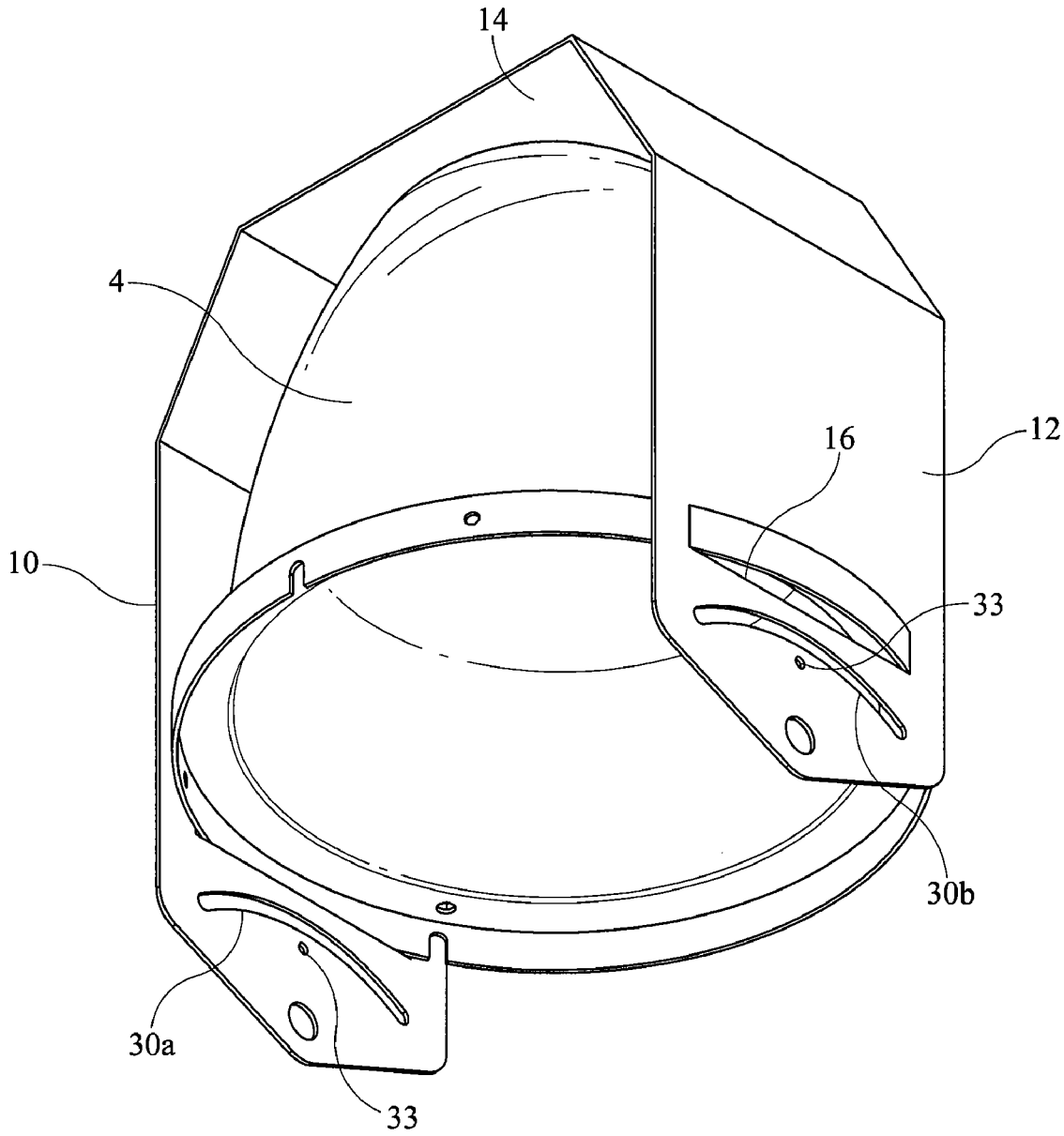
FIGS. 3*a-d* are perspective views of the reflector housed in the yoke.
Figure 3B:
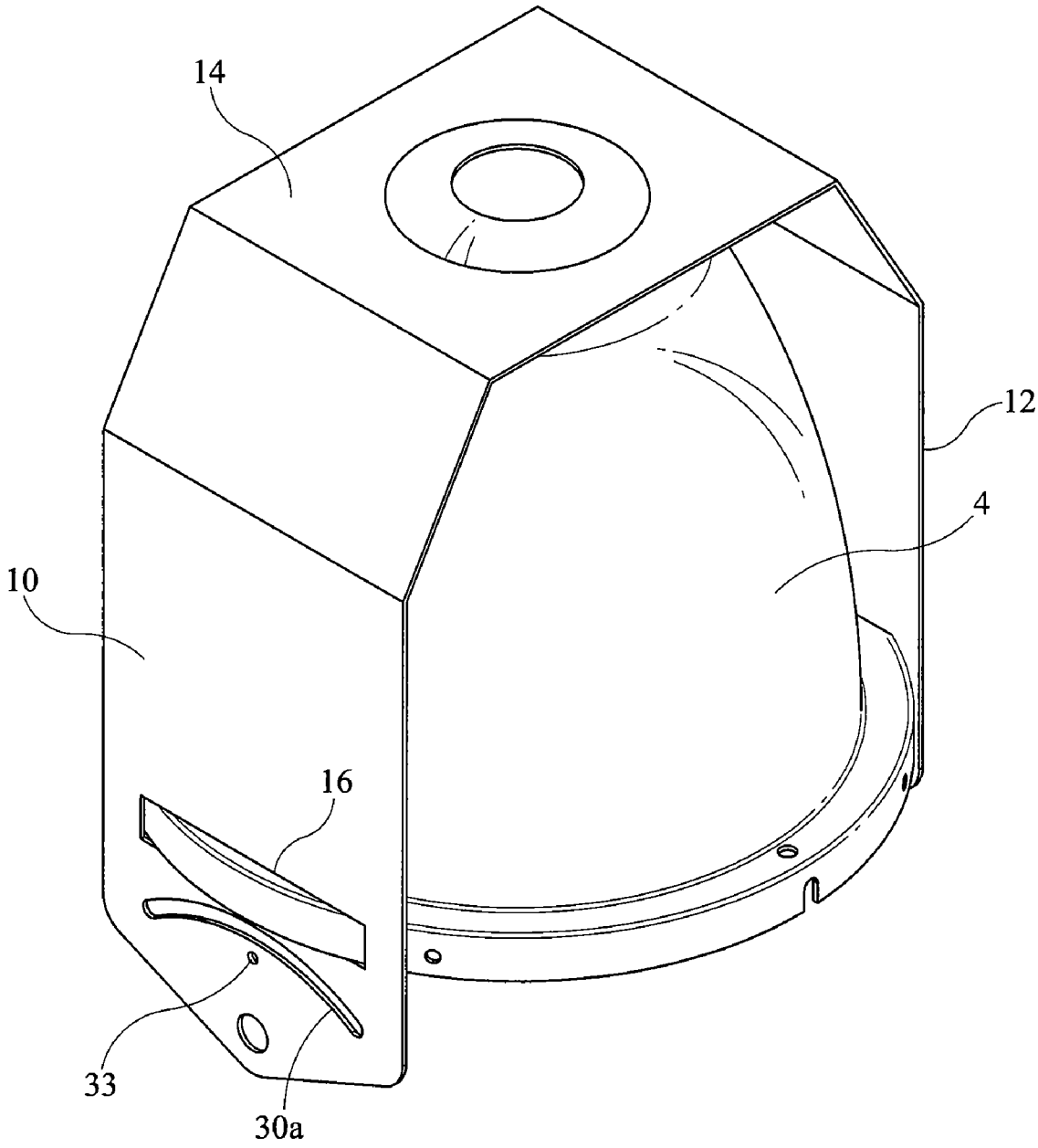
Figure 3C:
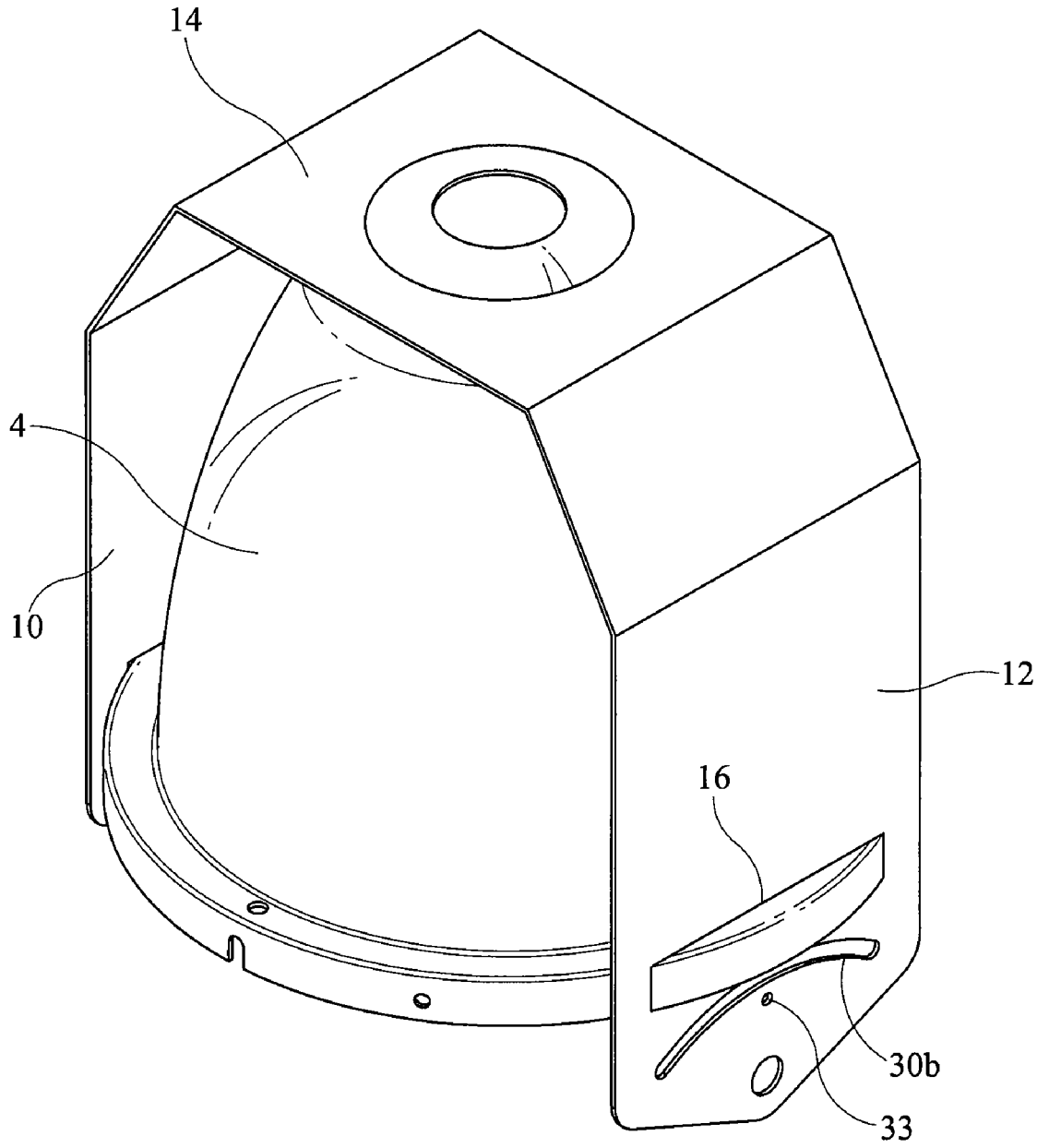
Figure 3D:
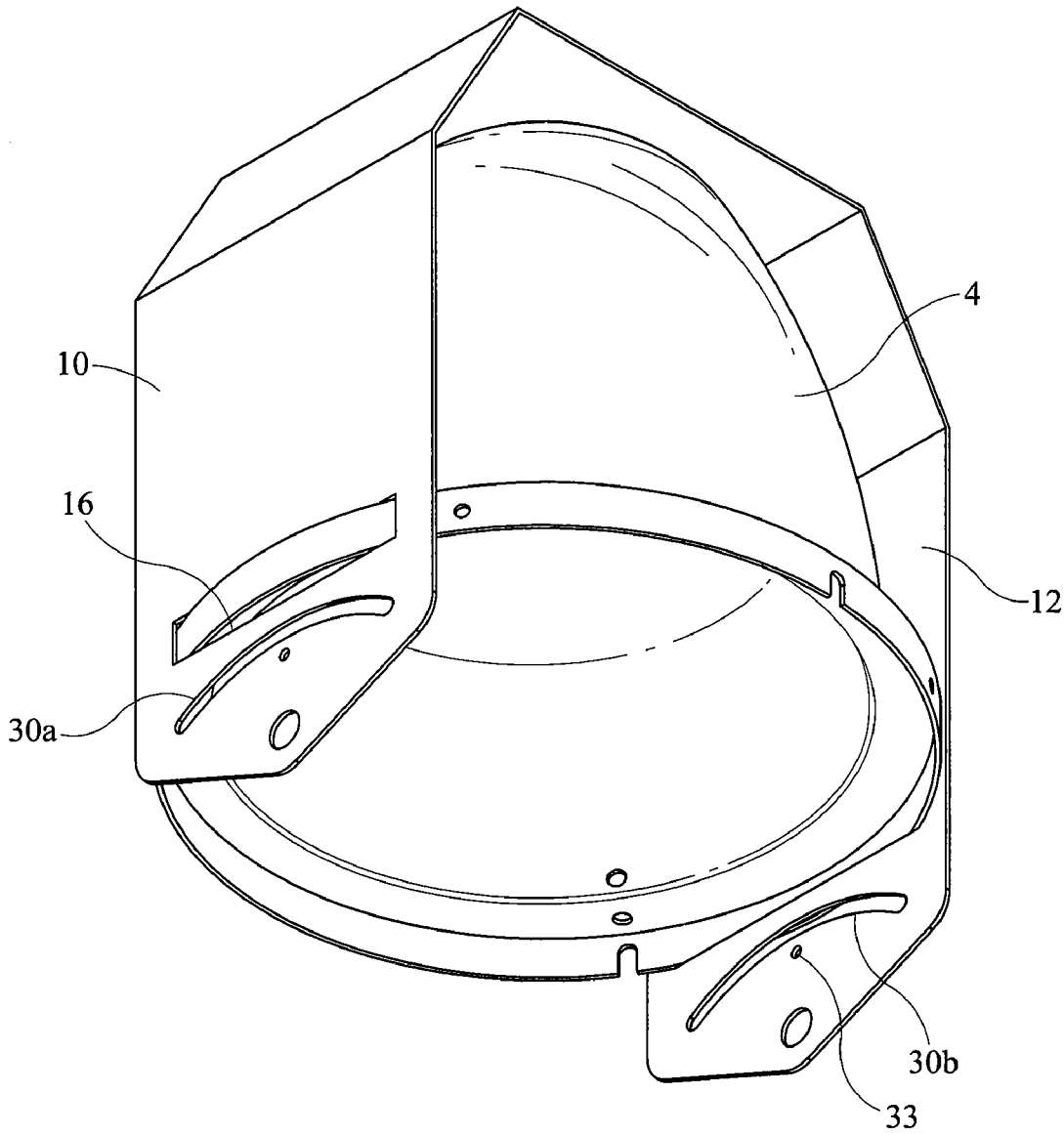
Figure 3E:
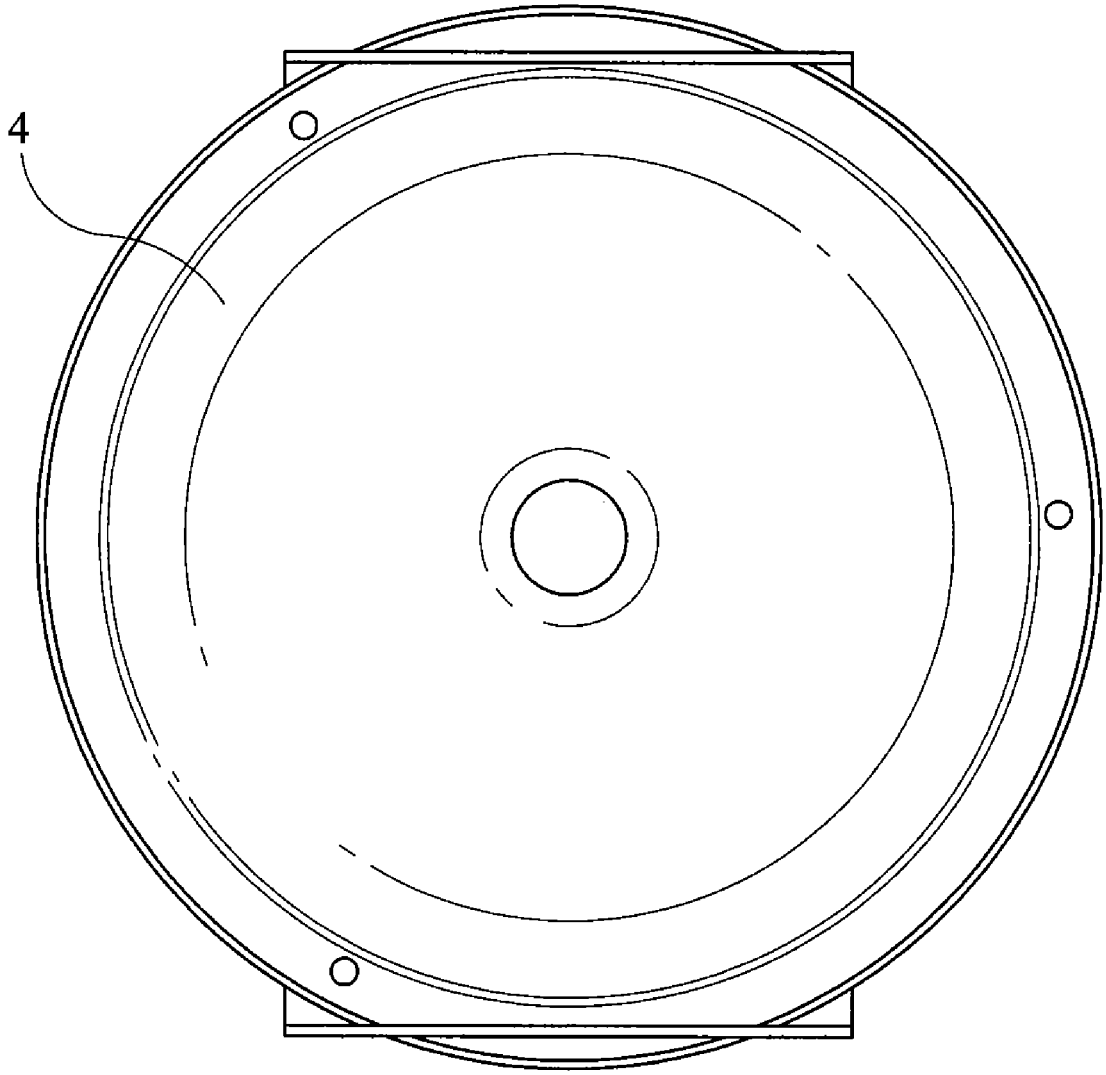
FIG. 3*e* is a top view of the reflector housed in the yoke.

As shown in more detail in FIG. 1*b* and FIG. 2, the yoke assembly 90 comprises a yoke 2 and two secondary support pieces 22*a-b* that connect the yoke 2 to an enclosure 18. The yoke 2 can be a U-shaped piece comprising a base 14, a first arm 10, and a second arm 12. In the preferred embodiment of the invention, the first arm 10 and the second arm 12 each have elongated openings 16 into which the reflector 4 fits snugly so that no other attachment means are necessary to coordinate movement between the parts of the optics assembly, as can be seen in FIGS. 3*a-c*. When the yoke 2 moves, the reflector 4 moves in concert.

The reflector 4 should be large enough to hold a lamp, but it can be virtually any shape necessary in order to accommodate a similarly shaped luminaire. In one embodiment shown in FIGS. 1*a* and 1*b*, the reflector 4 is in the shape of a bell. The only limitation on the design of the reflector 4 is that it must fit within the yoke 2, but it is also advantageous if the reflector 4 is light enough to allow the optics assembly to be easily adjustable. The reflector 4 is typically metal, such as aluminum, but it can comprise any material that can withstand the deleterious effects of the heat from an enclosed luminaire.

The enclosure 18, shown in FIG. 1*a*, comprises a cubic structure having a partially open face 17, a back 19 opposite the face 17, and four substantially rectangular sides 18*a-d*. The partially open face 17 of the enclosure 18 has an opening 21 through which light shines from a lamp located within the reflector 4. In one embodiment of the invention, the opening 21 is circular, and it is placed in the middle of the face 17.

The enclosure 18 serves several purposes in the lighting fixture 100. The enclosure 18 contains the optics assembly. In addition, when the lighting fixture 100 is placed in a ceiling, the enclosure 18 protects the reflector 4 from damage that may result from projectiles impacting the light fixture 100 during the insertion process or additional construction as well as protection from insulation or other material. Finally, the enclosure 18 also prevents the surrounding area from heating up and reaching dangerous temperatures.

As mentioned above, the yoke assembly 90 further comprises two secondary support pieces 22*a-b* (FIG. 1*b* and FIG. 2) that connect the yoke 2 to the enclosure 18. In one embodiment, the secondary support pieces 22*a-b* are substantially trapezoidal in shape and are mounted on opposite sides of the partially open face 17 of the enclosure 18. The trapezoidal pieces 22*a-b* are mounted on the enclosure 18 along the edge of their longest "bottom" sides 23*a-b* and jut inward at the face 17 of the enclosure 18 such that they are perpendicular to the face 17. When a secondary support piece 22 is mounted to the yoke, the bottom side 23 is flush against and parallel with the face 17 of the enclosure 18. The opposite "top" side 25 of the secondary support piece 22 is not parallel with the bottom side 23 but instead is offset at a small angle. As shown in FIG. 2, at the intersection of the top side 25 and each adjacent side 27 is an eyelet 29 through which each secondary support piece 22 removably attaches to the yoke 2, preferably by means of a pair of slidable connectors 24*a-b*, and 24*c-d*, which may be hexagonal screws or pins. As shown in FIG. 2, each secondary support piece 22 also has a secondary path 52 through which a thumbscrew 50 protrudes. Thumbscrew 50 protrudes through the secondary path 52 and indicator hole 33 on the yoke 2 so that the thumbscrew 50 can be attached to the yoke 2. After the thumbscrew 50 is attached to the yoke 2, gravity controlled pendulum 6 with indicator 8 is attached to the thumbscrew 50.

As also shown in FIG. 1*b* and FIG. 2, each of the arms 10, 12 of the yoke 2 has an arcuate track opening 30 through which the slidable connectors 24 protrude, thus forming a hinge. As shown in FIG. 2, the connectors 24*a-d* are in fixed locations in holes located near the top of secondary support pieces 22*a-b*. The connectors 24*a-d*, however, are free to slide through the track openings 30*a-b* when the yoke is being adjusted. The yoke 2 and the reflector 4 move along an axis defined by the hinge so that the movement of slidable connectors 24*a-d* in the respective curved track openings 30*a-b* controls the movement of the yoke and the reflector. Since the reflector 4 is secured to the yoke 2 as shown in FIGS. 3*a*-3*d*, when yoke 2 is adjusted the location of the reflector 4 is adjusted as well. The reflector 4, however, is also free to rotate about the axes formed by the connectors 24*a-d* and the arcuate track openings 30*a-b* independently of the yoke 2.

Because the connectors 24*a-d* are fixed in the secondary support pieces 22*a-b*, they prevent the yoke 2 from moving an extreme distance in the lateral direction, but the curvature of the track openings 30*a* and 30*b* is designed so that the yoke 2 can move the distance that is necessary to shift the optics assembly into the proper alignment no matter what angle at which the lighting fixture 100 is placed.

Figure 4:
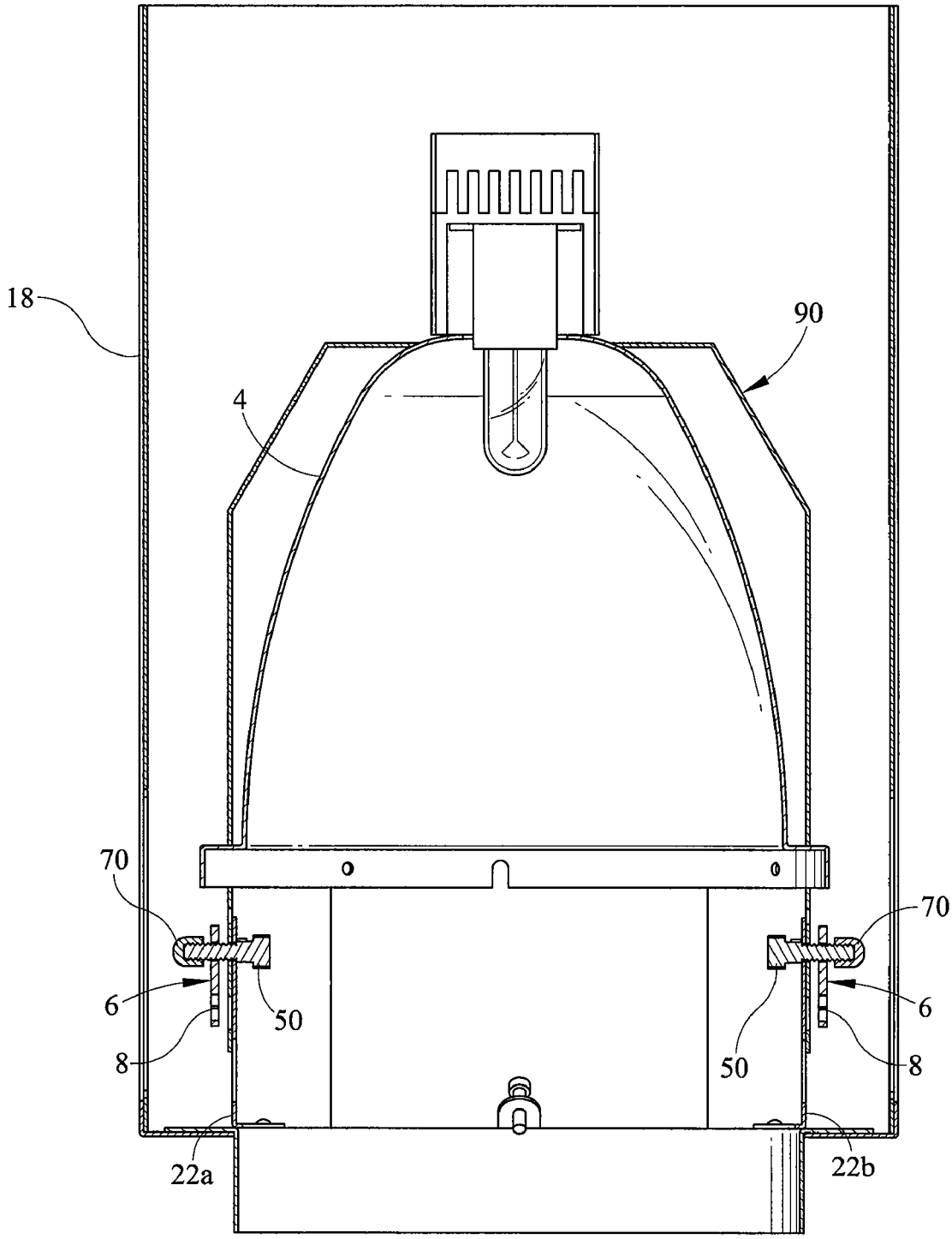
FIG. 4 is a cross-sectional view of the assembled lighting fixture.
Figure 5:
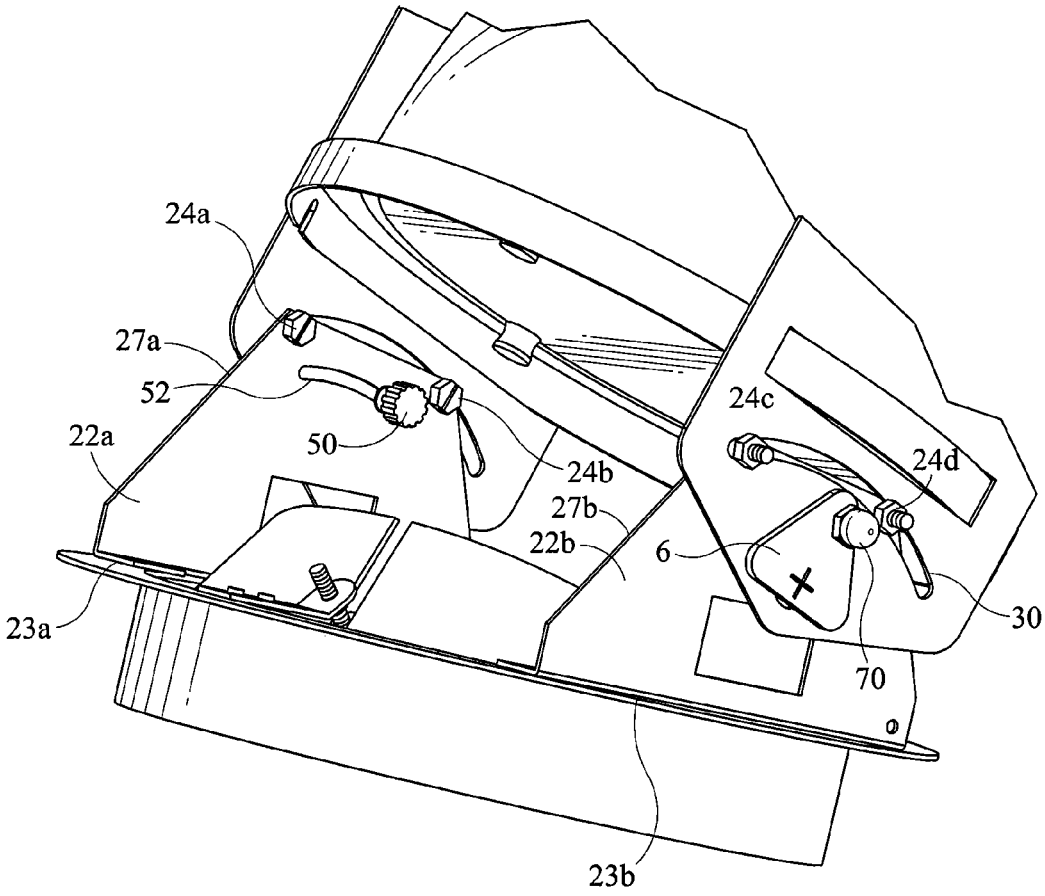
FIG. 5 is a perspective view of the hinge point of the yoke and the secondary support structure.

As shown more clearly in FIGS. 1*b*, 2, and 4 the aforementioned thumbscrew 50 extends through an opening at the bottom of the yoke 2 and protrudes through a secondary path 52 on a secondary support piece 22. In relation to the yoke 2, the thumbscrew 50 remains stationary when the yoke 2 is being adjusted. In relation to the secondary support piece, the thumbscrew 50 moves along the secondary path 52 when the yoke 2 is adjusted. The secondary support pieces 22*a-b* themselves remain in a fixed position relative to the enclosure 18, as do the connectors 24*a-d*. The thumbscrew 50 can be tightened so that the yoke 2 is no longer able to move once the yoke 2 and optics assembly are in the desired position.

As shown in FIGS. 1*a* and 1*c*, the enclosure 18 also preferably has one or more reference holes 60*a-b* through which the indicator 8 of the gravity-controlled pendulum 6 can be viewed during the alignment process. The gravity-controlled pendulum 6 can be placed anywhere on the yoke 2, but in the preferred embodiment, the gravity-controlled pendulum 6 rotates freely on the thumbscrew 50 so that when the yoke 2 moves on the slidable connectors 24 in the sloping track hole 30, the gravity-controlled pendulum 6 remains in a constant position with respect to the ground. In one embodiment, the gravity-controlled pendulum 6 maintains its position on the connector 24 due to a raised lip (not shown) on the thumbscrew 50. Alternative means, such as the capping nut 70 shown in FIG. 1*b* and FIG. 2 can be used as long as they do not interfere with the motion of the gravity-controlled pendulum 6. The movement of the pendulum 6 is not controlled by any other part of the invention, and it rotates with gravity. The indicator 8 can be any symbol or other marking that indicates when the optics assembly is aligned correctly, and in the preferred embodiment, it is a "plus" sign.

In one embodiment of the invention, the gravity-controlled pendulum 6 is a triangle made of plastic, but it can be made of metal or other materials. The gravity-controlled pendulum 6 should preferably be small and inexpensive to make, but it must be heavy enough that the force of gravity overcomes the force of friction at the intersection of the gravity-controlled pendulum 6, the thumbscrew 50, and, for example, the capping nut 70 shown in FIG. 1*b* and FIG. 2 so that the pendulum 6 rotates freely with the force of gravity.

In the associated method of the invention, to properly align the lighting fixture, the user placing the lighting fixture 100 in or on the ceiling can move the optics assembly by moving the yoke 2 along the path defined by the slidable connectors 24*a-d* and the curved track openings 30 until the indicator 8 of the gravity-controlled pendulum 6 is in the center of the reference hole. Once the optics assembly is in the desired position, pointing downward, the user can tighten the thumbscrew 50 until the optics assembly is no longer movable. After the thumbscrew 50 is tightened, the lighting fixture 100 should be ready for use.

While there have been described what are believed to be the preferred embodiments of the present invention, those skilled in the art will recognize that other and further changes and modifications may be made thereto without departing from the spirit of the invention, and it is intended to claim all such changes and modifications as fall within the true scope of the invention.

I claim:

1. A sloped ceiling light fixture comprising:

a light fixture housing having a yoke pivotally mounted in an interior space, said yoke having a first leg and a second leg and a support extending between said first leg and said second leg;

a reflector mounted to said support between said first leg and said second leg and having an illumination source;

a gravity-controlled pendulum pivotally mounted to said first leg or said second leg and visible through said housing;

wherein said first leg and said second leg each have a slot allowing said yoke to both rotate about said pivotal mount while also allowing a slide along said slot of said first leg and said second leg to move said yoke in a second direction.

2. The sloped ceiling light fixture of claim 1, wherein said slot in said first and said second leg is an arcuate slot and said second direction is along an arc defined by said slots.

3. A sloped ceiling lighting fixture for installation at an angle, comprising:

a housing surrounding a first and second support piece supporting a yoke and having a secondary support path, a reflector mounted within said yoke having a first and second leg;

said first and second leg of said yoke each rotatable about a pivot point connector extending through said secondary path of said first and second support piece thereby changing the downward angle of said reflector relative to said housing;

a pendulum mounted between said yoke and said housing rotatably mounted on said yoke for indicating said downward angle;

wherein as said yoke and reflector rotate relative to said first and second support piece, said pendulum rotates on said yoke indicating said downward angle and is visible through said housing.

4. A lighting fixture for a sloped ceiling comprising: an enclosure;

an optics assembly situated within said enclosure, said optics assembly comprising a reflector and a yoke having a first leg and a second leg;

said first leg and said second leg fixedly retaining a reflector;

said optics assembly further comprising at least one secondary support piece supporting said yoke;

at least one connector fixed in place in said secondary support piece and extending between said secondary support piece and said yoke, wherein said yoke has a track opening, wherein said at least one connector fits within said track opening and guides the movement of said yoke, said yoke and said reflector slidable about said track opening for allowing said reflector and a light source surrounded by said reflector to be rotatably adjustable relative to said secondary support piece;

and at least one gravity-controlled pendulum connected to said yoke, wherein said pendulum is visible through said enclosure and designed for being used to align said optics assembly.

5. The lighting fixture of claim 4 wherein said at least one secondary support piece has a secondary path and a thumbscrew that fits through said secondary path, wherein said thumbscrew attaches said secondary support piece and said yoke allowing independent movement of said reflector about said secondary path and said track opening of said yoke.

6. The lighting fixture of claim 5, wherein said thumbscrew is movable along said secondary path while said yoke is moving.

7. The lighting fixture of claim 6, wherein said thumbscrew can be tightened so as to make said optics assembly immobile.

8. The lighting fixture of claim 7, said enclosure comprising a reference hole in said enclosure, wherein said hole is in visual alignment with said pendulum.

9. A lighting fixture for a sloped ceiling installation comprising:

a yoke assembly wherein said yoke assembly has a yoke having a first leg and a second leg, one of said first and second leg having an arcuate track opening;

wherein said yoke assembly additionally has at least one secondary support piece that is fixedly attached relative to an enclosure and slidably attached to said yoke, wherein said at least one secondary support piece has a secondary track opening which receives a rotatable connector and which extends through said secondary track opening and one of said first or said second leg of said yoke, wherein at least one connector fits within said track opening of said yoke and slidably connects said secondary support piece to said yoke;

a reflector retained in position between said first leg and said second leg of said yoke, wherein said yoke and said reflector rotate and slidably move along a path defined by said track opening, wherein said reflector and said yoke are independently rotatable about an axis formed by said rotatable connector and along said arcuate track opening of said yoke;

a gravity controlled pendulum on at least one leg of an exterior surface of said yoke being visible through said enclosure and being freely rotatable on said yoke for indicating where said reflector is positioned relative to vertical with the ground.

10. The lighting fixture of claim 9 further comprising a reference hole in said enclosure in visual alignment with said pendulum.

11. The lighting fixture of claim 9, wherein said rotatable connector is a thumbscrew that fits through said secondary path and attaches said yoke to said secondary support piece to lock said yoke in position.

* * * * *